US010331063B2

(12) United States Patent
Miyazaki

(10) Patent No.: US 10,331,063 B2
(45) Date of Patent: Jun. 25, 2019

(54) FIXING DEVICE AND IMAGE FORMING APPARATUS

(71) Applicant: FUJI XEROX CO., LTD., Tokyo (JP)

(72) Inventor: Akio Miyazaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/946,121

(22) Filed: Apr. 5, 2018

(65) Prior Publication Data

US 2019/0033760 A1 Jan. 31, 2019

(30) Foreign Application Priority Data

Jul. 28, 2017 (JP) ..... 2017-146676

(51) Int. Cl.
*G03G 15/20* (2006.01)
*G03G 21/16* (2006.01)

(52) U.S. Cl.
CPC ..... *G03G 15/2053* (2013.01); *G03G 21/1652* (2013.01)

(58) Field of Classification Search
CPC ..... G03G 15/2053; G03G 21/1652
See application file for complete search history.

(56) References Cited

U.S. PATENT DOCUMENTS 5,115,119 A 5/1992 Adachi et al.
7,920,815 B2 4/2011 Miyake

FOREIGN PATENT DOCUMENTS

JP 3-27074 A 2/1991
JP 2012123421 A 6/2012

*Primary Examiner* — Hoang X Ngo
(74) *Attorney, Agent, or Firm* — Sughrue Mion, PLLC

(57) ABSTRACT

A fixing device includes a rotary member, a heating member provided inside the rotary member, supply parts that supply power to the heating member, cover parts that cover the supply parts, and fixing members that fix the rotary member in an axial direction. The cover parts have a restriction part that restricts movement of the rotary member in the axial direction.

11 Claims, 7 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2017-146676 filed Jul. 28, 2017.

BACKGROUND

Technical Field

The present invention relates to a fixing device and an image forming apparatus.

SUMMARY

According to an aspect of the invention, there is provided a fixing device including: a rotary member; a heating member provided inside the rotary member; supply parts that supply power to the heating member; cover parts that cover the supply parts; and fixing members that fix the rotary member in an axial direction. The cover parts have a restriction part that restricts movement of the rotary member in the axial direction.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described below with reference to the drawings. Note that the exemplary embodiments described below show, as examples, a fixing device and an image forming apparatus for embodying the technical idea of the present invention and are not intended for limiting the present invention thereto. The present invention can be equally applicable to other exemplary embodiments included in the scope of the claims.

First Exemplary Embodiment

Figure 1:
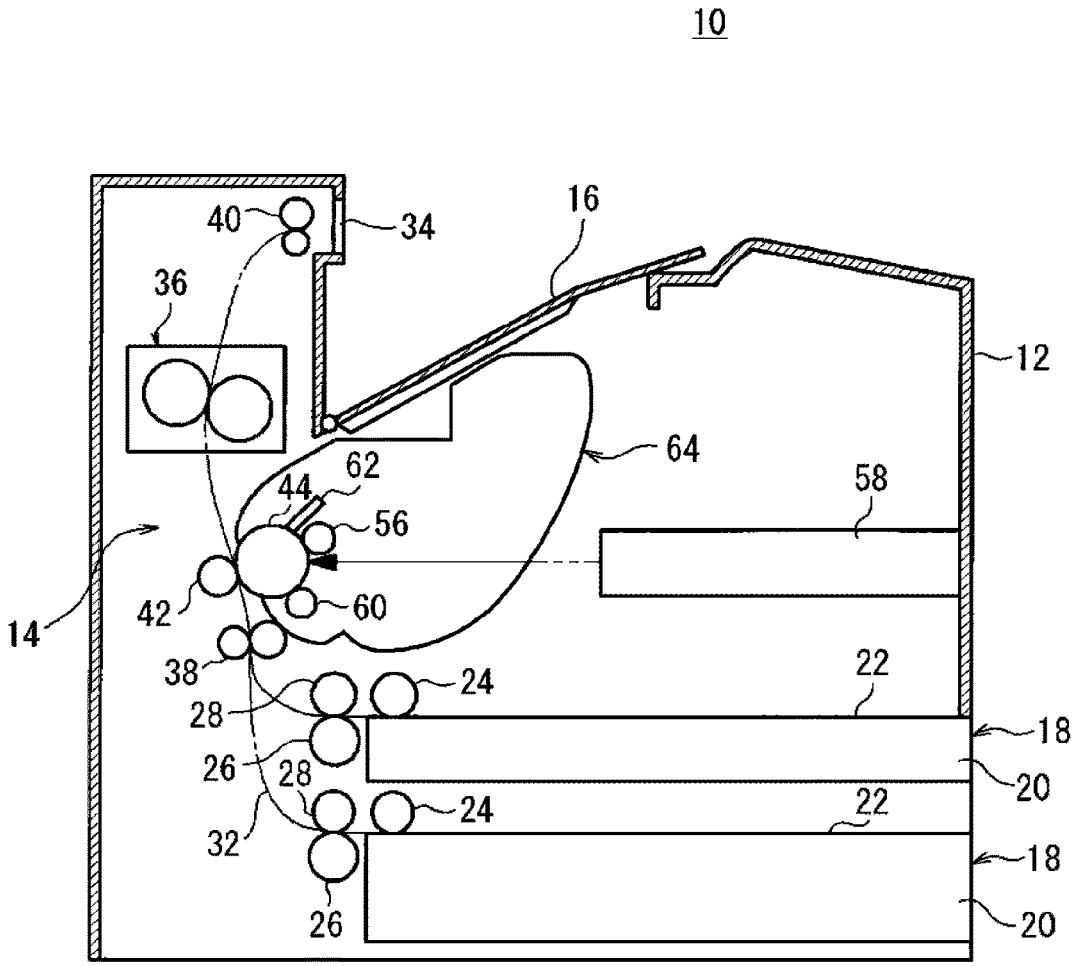
FIG. 1 is a vertical sectional view of an image forming apparatus according to first to third exemplary embodiments.

Referring to FIGS. 1 to 4, an image forming apparatus 10 according to a first exemplary embodiment will be described. As shown in FIG. 1, the image forming apparatus 10 according to the first exemplary embodiment includes an image forming apparatus body 12, and at least one sheet feed unit 18, an image forming unit 14, and a fixing device 36, which are accommodated in the image forming apparatus body 12. The image forming apparatus body 12 has a discharge port 34 at the top. A transport path 32 along which a recording medium 140, such as a recording sheet, serving as a medium to which an image is transferred, is transported is provided so as to communicate between the above-described components. The configurations of these components will be described below.

The sheet feed units 18 each include a sheet feed unit body 20, a sheet feed cassette 22 that accommodates the recording media 140, a pickup roller 24 that picks up the recording media 140 stacked in the sheet feed cassette 22, and a feed roller 28 and a retard roller 26 that feed the recording media 140 while separating them into individual media. As the pickup roller 24, the feed roller 28, and the retard roller 26 rotate, the recording media 140 in the sheet feed cassette 22 are transported along the transport path 32 to registration rollers 38 (described below). The sheet feed cassette 22 is removably attached to the sheet feed unit body 20. Although there are two sheet feed units 18 in the first exemplary embodiment, as shown in FIG. 1, the number of the sheet feed units 18 may be one, or more than two.

The image forming unit 14 uses an electrophotographic system and includes: an image carrier 44, which is formed of a photoconductor; a charging device 56 that is formed of, for example, a charging roller and uniformly charges the image carrier 44; a photo-writing device 58 that writes, with light, a latent image on the image carrier 44 charged by the charging device 56; a developing device 60 having a developing roller that develops the latent image formed on the image carrier 44 by the photo-writing device 58 into a visible image using toner; a transfer device 42 that is formed of, for example, a transfer roller for transferring the toner image formed by the developing device 60 to a recording medium 140; a cleaning device 62 for cleaning the residual toner on the image carrier 44; and a fixing device 36 that fixes the toner image transferred to the recording medium 140 by the transfer device 42 to the recording medium 140.

The photo-writing device 58 is formed of, for example, a scanning laser exposure device that forms a latent image on the image carrier 44 through a process cartridge 64 (described below). In other exemplary embodiments, the photo-writing device 58 may alternatively be an LED, a surface emitting laser, or the like.

The process cartridge 64 includes the image carrier 44, the charging device 56, the developing device 60, and the cleaning device 62, which are integrated together, and is replaceable.

The transport path 32 is a path for the recording media 140 and is continuous from the pickup roller 24 of the sheet feed unit 18 at the bottom of the image forming apparatus body 12 to the discharge port 34 at the top of the image forming apparatus body 12. The transport path 32 is located inside the image forming apparatus body 12 and has a substantially vertical portion extending from the pickup roller 24 of the sheet feed unit 18 at the bottom to the fixing device 36.

On the transport path 32, the transfer device 42 and the image carrier 44 are located upstream of the fixing device 36, and the registration rollers 38 are located upstream of the transfer device 42 and the image carrier 44. Furthermore, discharge rollers 40 are provided on the transport path 32, near the discharge port 34.

Recording media 140 fed from the sheet feed cassette 22 in the sheet feed unit 18 by the pickup roller 24 are separated into individual media by the retard roller 26 and the feed roller 28. Then, each of the separated media is guided to the transport path 32, is temporarily stopped by the registration rollers 38, and is then caused to pass between the transfer device 42 and the image carrier 44 at a certain timing, during which a developer image is transferred to the medium. The transferred developer image is fixed to the medium by the fixing device 36, and the medium is discharged from the discharge port 34 to the discharge portion 16 by the discharge rollers 40.

Figure 2:
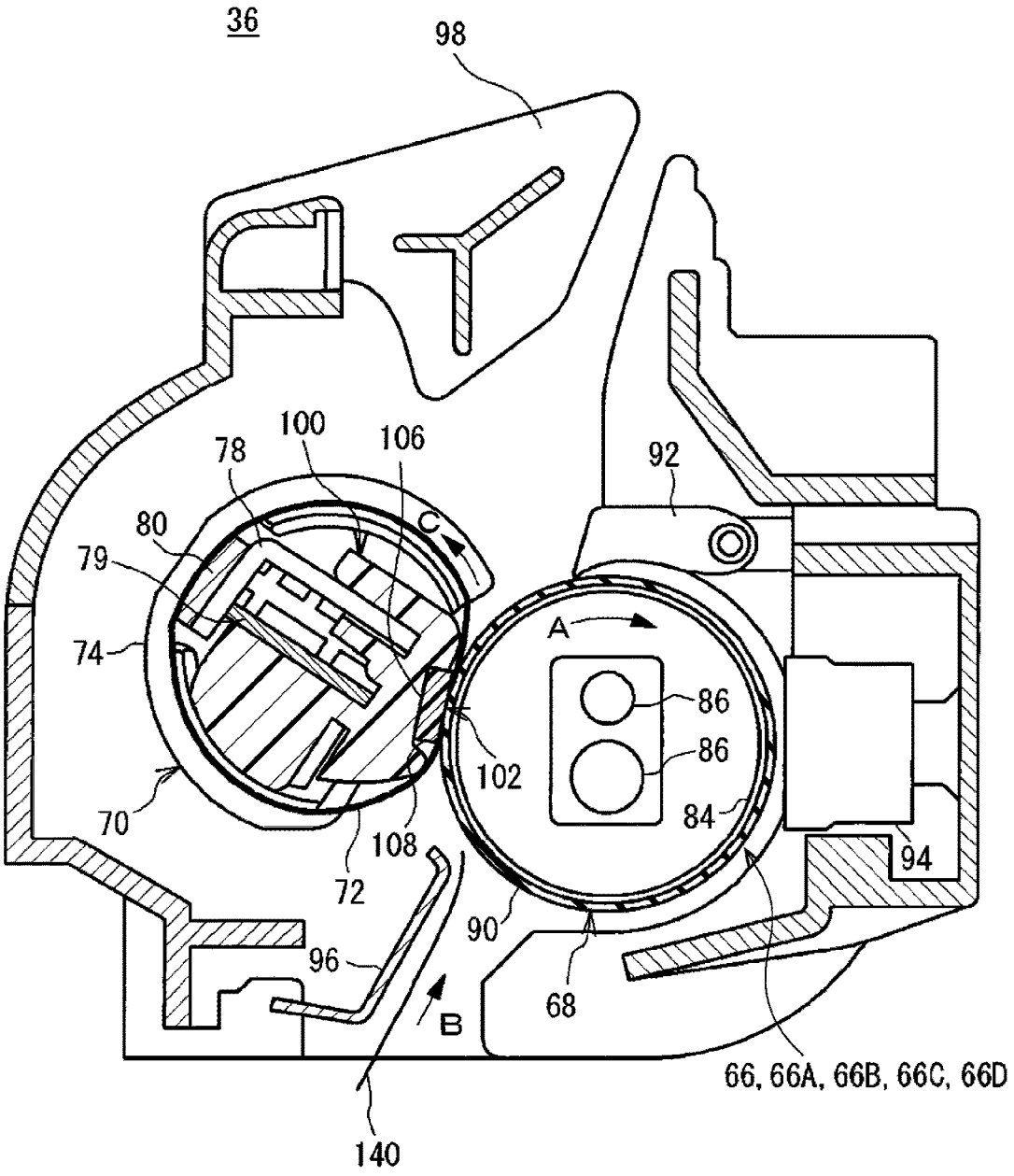
FIG. 2 is a vertical sectional view of a fixing device according to the first to third exemplary embodiments.

Furthermore, as shown in FIG. 2, the fixing device 36 includes: a heating unit 66; an endless belt 72, serving as an endless belt body; guide members 74 that guide the endless belt 72 so as to allow rotation thereof; and a pressure part 70 that is disposed in the endless belt 72 and is pressed toward the heating roller 68, together with the endless belt 72.

Figure 3A:
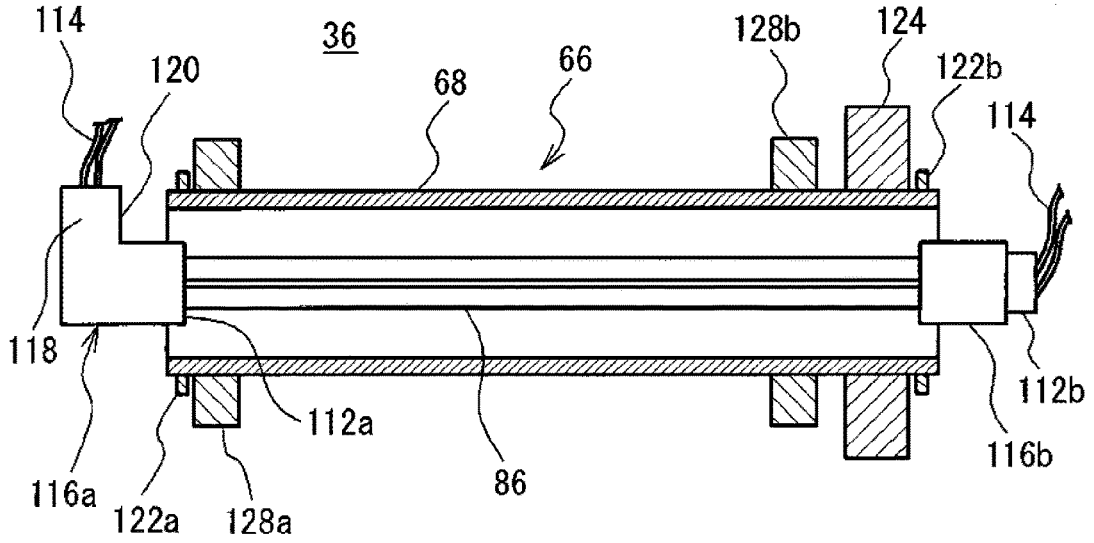
FIG. 3A is a sectional view of a heating unit.

As shown in FIGS. 2 and 3A, the heating unit 66 includes: a heating roller 68, which is a tubular rotary member capable of rotation; heaters 86, serving as heating members and disposed inside the heating roller 68; gear 124, serving as a transmitting member, that transmits a driving force for rotating the heating roller 68 from a driving-force source (not shown); a pair of bearing members 128*a* and 128*b* that support the heating roller 68 so as to allow rotation thereof; and a pair of fixing members 122*a* and 122*b* fixed to the heating roller 68 to keep the heating roller 68 in a predetermined rotation position.

In the first exemplary embodiment, the bearing member located at one end, which is an end closer to a cover part 116*a* (described below) having a restriction part 120, is the bearing member 128*a*, and the bearing member located at the other end, which is an end closer to a cover part 116*b* having no restriction part, is the bearing member 128*b*. Similarly, the fixing member located at one end is the fixing member 122*a*, and the fixing member located at the other end is the fixing member 122*b*. The fixing members 122*a* and 122*b* may be collectively referred to as the fixing members 122, and the bearing members 128*a* and 128*b* may be collectively referred to as the bearing members 128.

The heating roller 68 is a so-called hard roller, which does not have an elastic layer, and is formed of a cylindrical roller portion 84 and a releasing layer 90 covering or applied to the roller portion 84. The heating roller 68 is supported by the bearing members 128 at both ends so as to be capable of rotation in a direction of arrow A (see FIG. 2).

The roller portion 84 is made of metal, such as iron, stainless steel, or aluminum. The releasing layer 90 is formed of an insulating and highly releasable material, such as PFA. A separation member 92 is in contact with the heating roller 68.

Figure 4A:
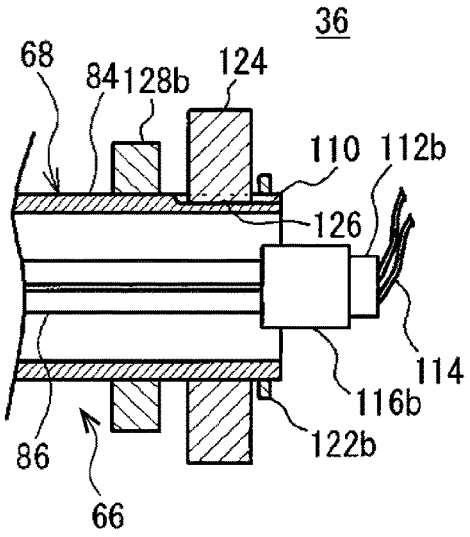
FIG. 4A is a partial sectional view showing a detailed configuration of a gear-side portion of the heating unit.
Figure 4B:
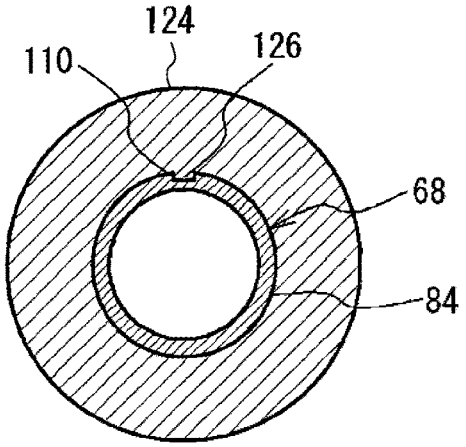
FIG. 4B is a sectional view of the heating unit, as viewed from the other end.

As shown in FIGS. 4A and 4B, the heating roller 68 has a groove extending in the longitudinal direction from one end. This groove serves as a key groove 110 to mesh with the gear 124 (described below). The depth of the key groove 110 is substantially half the thickness of the roller portion 84.

The gear 124 provided at one end of the heating roller 68 transmits, to the heating roller 68, a rotational driving force exerted by a driving part, such as a motor, provided inside the image forming apparatus body 12. The gear 124 is, for example, a cylindrical helical gear, which has a helical tooth trace.

Furthermore, the gear 124 has a projecting portion 126 on the inner circumference, that is, on the circumference closer to the heating roller 68 (see FIGS. 4A and 4B). The projecting portion 126 enters the key groove 110 formed in the heating roller 68 so as to extend in the axial direction, thus meshing together the gear 124 and the heating roller 68, thereby allowing the driving force to be more smoothly transmitted.

The fixing members 122, which are, for example, C rings, are attached to both ends of the heating roller 68, at predetermined positions, to keep the rotation position of the heating roller 68 within a predetermined position. The fixing members 122 are each provided at the corresponding end of the heating roller 68 in the longitudinal direction. In the first exemplary embodiment, the fixing member 122*b* at the other end is attached on the outer side of the gear 124, and the fixing member 122*a* at one end is provided on the outer side of the bearing member 128*a*, which is provided opposite from the gear 124. When a large displacement of the rotating heating roller 68 from the predetermined rotation position is likely to occur, the fixing member 122*a* and the bearing member 128*a* at one end come into contact with each other, or the gear 124 and the bearing member 128*b* at the other end come into contact with each other, reducing the displacement of the heating roller 68 from the rotation position and keeping the heating roller 68 at the predetermined position.

The heaters 86 are disposed inside the heating roller 68 and include, for example, two lamp heaters. A thermostat 94 is provided on the opposite side of the heating roller 68 from the endless belt 72 so as to face the heating roller 68. The heaters 86 may be known heaters, such as halogen lamp heaters or carbon lamp heaters.

The heaters 86 have, at one end and the other end in the axial direction (the longitudinal direction), supply parts 112*a* and 112*b* to which power is supplied through lead wires 114 connected to the inside of the image forming apparatus body 12. The supply parts 112*a* and 112*b* are covered, together with portions of the lead wires 114, by cover parts 116*a* and 116*b*.

The cover part at one end, which is a cover part having a restriction part 120 (described below) is the cover part 116*a*, and the cover part at the other end, which is a cover part having no restriction part 120 is the cover part 116*b*. Similarly, the supply part at one end is the supply part 112*a*, and the supply part at the other end is the supply part 112*b*. The supply parts 112*a* and 112*b* may be collectively referred to as the supply parts 112, and the cover parts 116*a* and 116*b* may be collectively referred to as the cover parts 116.

The cover parts 116 are so-called insulators covering the supply parts 112 so as to be integral therewith. The cover parts 116 are formed of a strong, heat-proof material, such as ceramics.

The cover parts 116 at both ends have different shapes. The cover part 116*a* at one end, that is, the cover part 116*a* located opposite from the gear 124 when assembled into the heating unit 66 in the first exemplary embodiment, has the restriction part 120. The cover part 116*b* opposite from the cover part 116*a* having the restriction part 120 does not have the restriction part.

The cover part 116*a* according to the first exemplary embodiment has a projecting portion 118 projecting, together with the lead wires 114, in a direction intersecting the longitudinal direction of the heaters 86 (e.g., the vertical direction) and thus has an L shape. A surface of the projecting portion 118 of the cover part 116*a* facing the heating roller 68 serves as the restriction part 120.

The projecting portion 118 extends to, at least, a position at substantially the same height as the roller portion 84 of the heating roller 68. More specifically, the projecting portion 118 projects to a position at which the restriction part 120 of the projecting portion 118 comes into contact with the end of the heating roller 68 when the heating roller 68 has moved in the rotation-axis direction. The projecting portion 118 may be higher than the heating roller 68. The restriction part 120 formed on the cover part 116*a* will be described in detail below.

As shown in FIG. 2, the pressure part 70 includes a carrier 100 disposed on the inner side the endless belt 72, a pressure member 108 attached to the carrier 100, and frames 78 and 79 that support the carrier 100. An impregnation pad 80 for supplying lubricant is provided on the inner side of the endless belt 72.

When the pressure part 70 is pressed against the heating roller 68, a pressure area 102 is formed by the pressure member 108 attached to the carrier 100. The pressure part 70 presses the pressure member 108 toward the heating roller 68, in cooperation with the carrier 100 and the frames 78 and 79.

The carrier 100 is formed of a resin material, such as a heat-resistant liquid crystal polymer (LCP). As shown in FIG. 2, the carrier 100 has, on the side facing the heating roller 68, a surface 106 to which the pressure member 108, which forms the pressure area 102, is attached.

The pressure member 108 has substantially the same length as the carrier 100 in the longitudinal direction and is formed in a substantially rectangular-parallelepiped shape from a heat-resistant resin material, such as silicone rubber.

As shown in FIG. 2, the guide members 74 are disposed at both ends of the endless belt 72 and the pressure part 70, and the pressure part 70 is supported by the guide members 74.

As shown in FIG. 2, the frames 78 and 79 support the carrier 100. The ends of the frames 78 and 79 are supported by the guide members 74, and the carrier 100 is urged toward the heating roller 68.

The endless belt 72 is provided between the heating roller 68 and the pressure part 70 and travels in the direction of arrow C so as to follow the rotation of the heating roller 68 (see FIG. 2). The pressure part 70 presses the endless belt 72 toward the heating roller 68, forming the pressure area 102, where a toner image is fixed to a recording medium 140. The endless belt 72 is formed in a belt-like shape from a synthetic resin, such as polyimide, and has a releasing layer, formed of PFA or the like, on the surface thereof.

An inlet chute 96 is provided upstream of the pressure area 102. A recording medium 140 transported in the direction of arrow B is guided into the inlet chute 96, and the distal end of the recording medium 140 is guided to the pressure area 102 (see FIG. 2). An outlet chute 98 is provided downstream of the pressure area 102.

Next, the restriction part 120 provided on the cover part 116*a* of the heating unit 66 in the fixing device 36 according to the first exemplary embodiment will be described.

As shown in FIG. 3A, the heating roller 68 of the heating unit 66 in the fixing device 36 according to the first exemplary embodiment has the fixing members 122*a* and 122*b* on the outer circumference thereof, on the outer side of the bearing member 128*a* and on the outer side of the gear 124, respectively, to reduce a large displacement of the heating roller 68 from the predetermined rotation position.

If the fixing member 122*b* near the gear 124 falls off while the image forming apparatus 10 is used, that is, while the heating roller 68 is rotating, the rotating heating roller 68 moves away from the fixing member 122*b*, that is, away from the gear 124. When the gear 124 is a helical gear, the heating roller 68 easily moves due to a thrust force (a force in the axial direction) along the shape of the obliquely extending (helical) teeth.

Figure 5A:
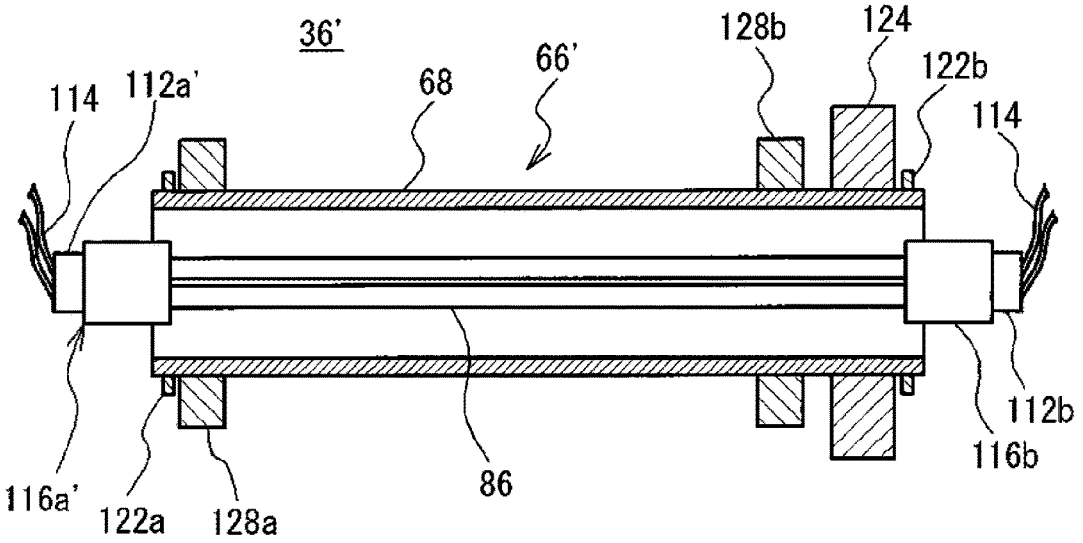
FIG. 5A is a sectional view of the heating unit in which a cover part does not have a restriction part.
Figure 5B:
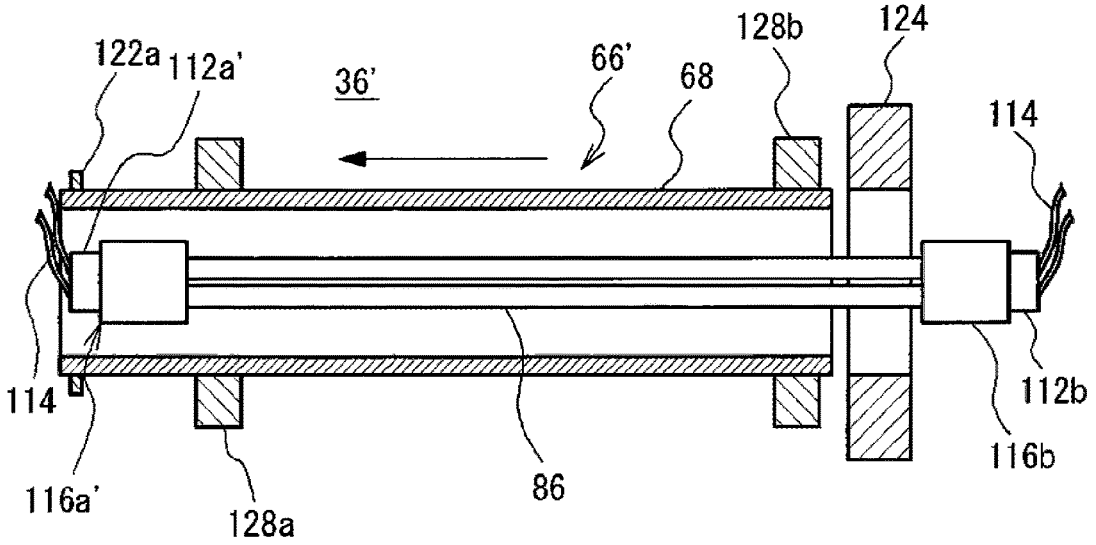
FIG. 5B is a sectional view showing a state in which the heating roller has moved.

In this case, if the fixing member 122*b* comes off from the heating roller 68 when a cover part 116*a*' does not have the restriction part 120 as in a heating unit 66' of a fixing device 36' shown in FIG. 5A, a large displacement of the heating roller 68 from a predetermined position may occur, as shown in FIG. 5B.

Figure 3B:
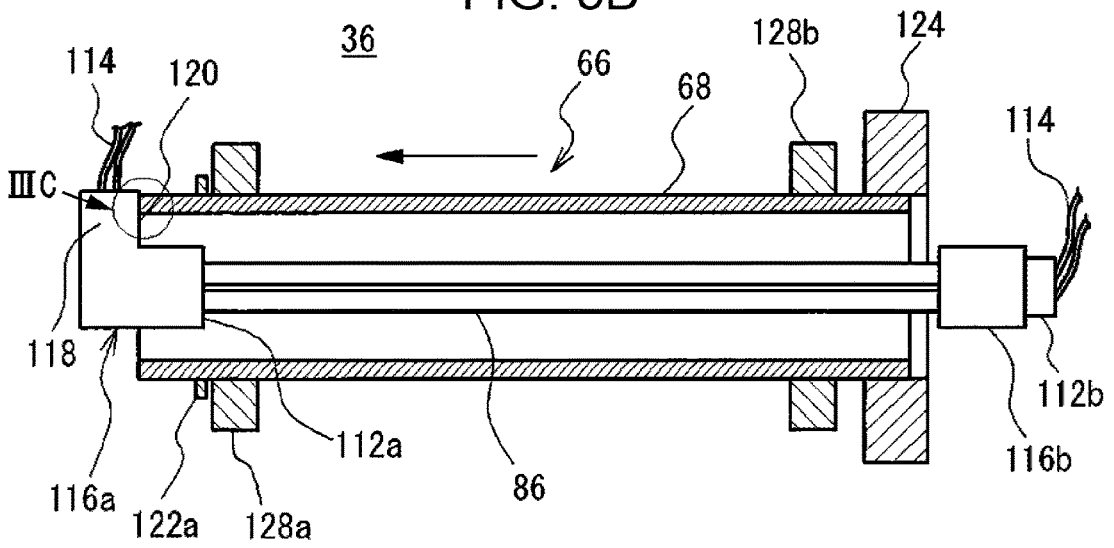
FIG. 3B is a sectional view showing a state in which a heating roller of the heating unit has moved.
Figure 3C:
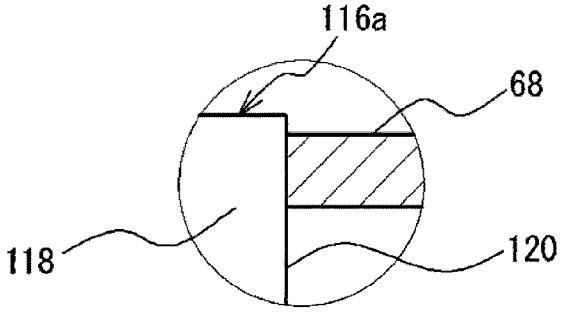
FIG. 3C is an enlarged view of a part IIIC in FIG. 3B.

In contrast, as in the heating unit 66 according to the first exemplary embodiment shown in FIG. 3A, when the cover part 116*a* of the supply part 112*a* of the heaters 86 has the restriction part 120, as shown in FIGS. 3B and 3C, even if the heating roller 68 moves, it comes into contact with the restriction part 120, and the movement of the heating roller 68 is restricted. Hence, even if the fixing member 122*b* comes off, the movement of the heating roller 68 restricted.

Furthermore, because the movement of the heating roller 68 is restricted by the restriction part 120 of the projecting portion 118, contact with the lead wires 114 extending and guided from the supply part 112*a* is reduced.

Figure 4C:
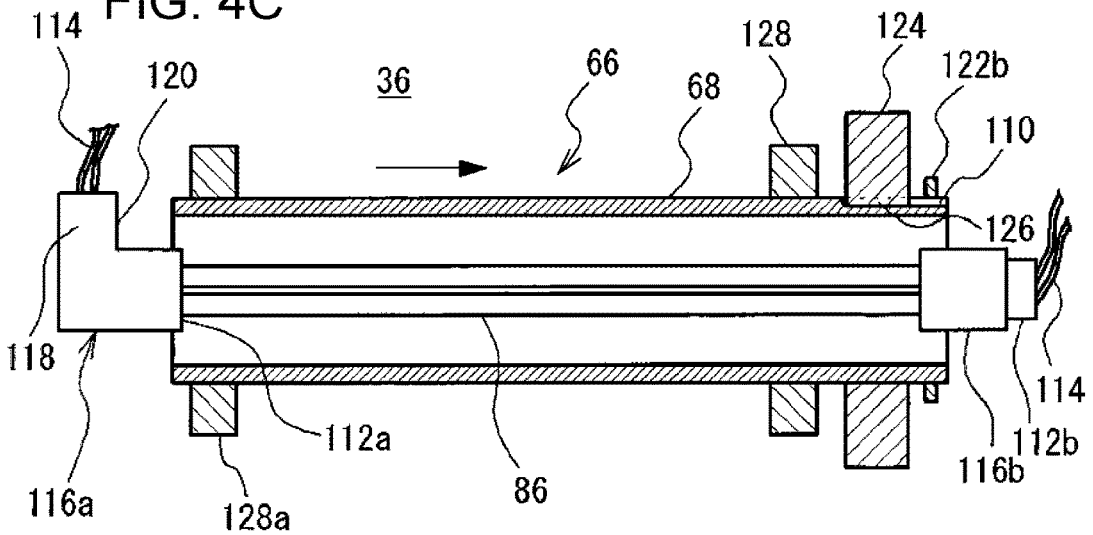
FIG. 4C is a sectional view showing a state in which the heating roller of the heating unit has moved.

When the fixing member 122*a* on the opposite side of the heating roller 68 from the gear 124 comes off, the projecting portion 126 formed on the inner circumference of the gear 124 engages with the end of the key groove 110 formed in the heating roller 68, reducing the movement of the heating roller 68 toward the gear 124 (see FIG. 4C).

Furthermore, although the cover parts 116 are provided at both ends of the heating unit 66 in the longitudinal direction of the heaters 86, the restriction part 120 is provided only on one of the cover parts 116. Thus, the cover part opposite from the cover part having the restriction part does not have the restriction part.

As shown in FIG. 3A, in the first exemplary embodiment, the restriction part 120 formed on the cover part 116*a* is located at one end of the heaters 86, that is, on the opposite side from the gear 124 provided on the heating roller 68. Thus, the restriction part is not formed on the cover part 116*b* provided near the gear 124. Because the restriction part 120 is provided only on the cover part 116*a*, it is possible to easily insert the heaters 86 into the heating roller 68, thus making assembly easy.

Modification

Figure 6A:
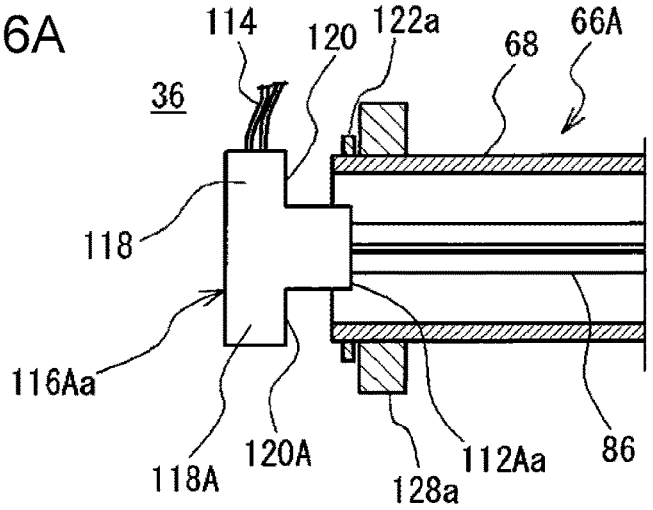
FIG. 6A is a partial sectional view of the heating unit according to a modification of the first exemplary embodiment.

In the first exemplary embodiment, although the projecting portion 118 of the cover part 116*a* having the restriction part 120 is provided so as to project only in the direction in which the lead wires 114 extend, it is also possible to form another projecting portion 118A projecting in the direction opposite to the direction in which the lead wires 114 extend and are guided, thus forming a T shape, as in a cover part 116Aa of a heating unit 66A shown in FIG. 6A.

With this configuration, the projecting portions 118 and 118A projecting at both sides of the cover part 116Aa covering the supply part 112Aa respectively have the restriction parts 120 and 120A for restricting the movement of the heating roller 68. Hence, even the heating roller 68 that has moved can be stably rotated. Furthermore, by increasing the number of the restriction parts 120 and 120A with which the heating roller 68 comes into contact, damage to the cover part 116Aa is reduced.

The number of projecting portions formed on the cover part may be three or more, or the projecting portion may have a circular shape so as to surround the cover part.

Second Exemplary Embodiment

In the first exemplary embodiment, the restriction part 120 is provided on the cover part 116*a* that covers the supply part 112*a* having the projecting portion 118 projecting with the lead wires 114. In the second exemplary embodiment, a cover part 116Ba of a heating unit 66B has a projecting portion 119B projecting in a direction different from the direction in which the lead wires 114 extending from a supply part 112Ba are guided, and a restriction part 120B is provided in the projecting portion 119B. The configurations the same as those in the first exemplary embodiment will be denoted by the same reference signs, and detailed descriptions thereof will be omitted.

Figure 6B:
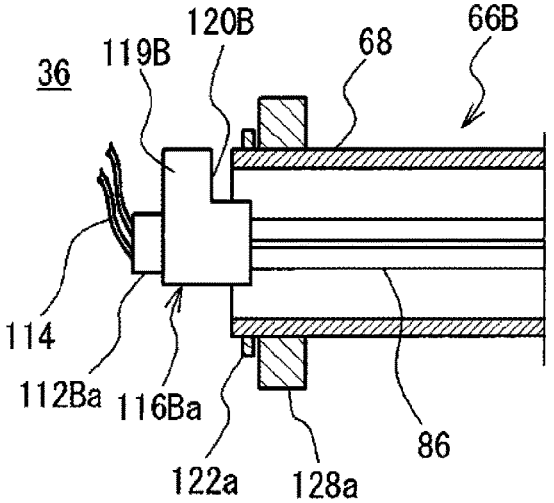
FIG. 6B is a partial sectional view of the heating unit according to the second exemplary embodiment.

For example, the lead wires 114 extend and are guided from the supply part 112Ba in the longitudinal direction of the heaters 86 (see FIG. 6B). The projecting portion 119B is formed on the cover part 116Ba that covers the supply part 112Ba to which the lead wires 114 are guided.

Specifically, as shown in FIG. 6B, the cover part 116Ba of the heating unit 66B according to the second exemplary embodiment covers the supply part 112Ba to which the lead wires 114 extending in the longitudinal direction of the heaters 86 are guided. The cover part 116Ba has the projecting portion 119B projecting in a direction different from the direction in which the lead wires 114 extend, which direction intersects the longitudinal direction of the heaters 86, that is, for example, the vertical direction. A surface of the projecting portion 119B facing the heating roller 68 constitutes the restriction part 120B.

With this configuration, it is possible to freely set the direction in which the lead wires 114 are guided, even when the projecting portion 119B is formed on the cover part 116Ba.

Modification

Figure 6C:
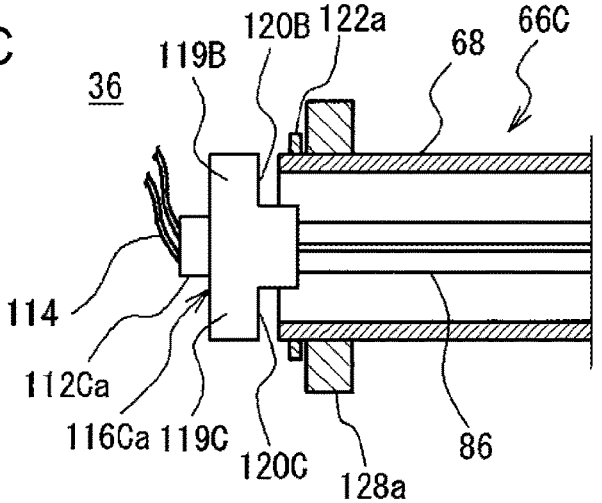
FIG. 6C is a partial sectional view showing a modification of the second exemplary embodiment.

Although the cover part 116Ba according to the second exemplary embodiment has one projecting portion 119B projecting in a direction intersecting the longitudinal direction of the heaters 86, as in a cover part 116Ca of a heating unit 66C shown in FIG. 6C, a projecting portion 119C may be formed so as to project in a direction different from the direction in which the lead wires 114 extending from the supply part 112Ca are guided, that is, for example, in a direction intersecting the lead wires 114 guided in the longitudinal direction of the heaters 86, in addition to the projecting portion 119B according to the second exemplary embodiment, and the projecting portions 119B and 119C may respectively have restriction parts 120B and 120C.

With this configuration, the projecting portions 119B and 119C projecting at both sides of the cover part 116Ca have the restriction parts 120B and 120C that restrict the movement of the heating roller 68. Thus, even the heating roller 68 that has moved can be stably rotated. Furthermore, by increasing the number of the restriction parts 120B and 120C with which the heating roller 68 comes into contact, damage to the cover part 116Ca is reduced.

The number of projecting portions formed on the cover part may be three or more, or the projecting portion may have a circular shape so as to surround the cover part.

Third Exemplary Embodiment

Figure 7A:
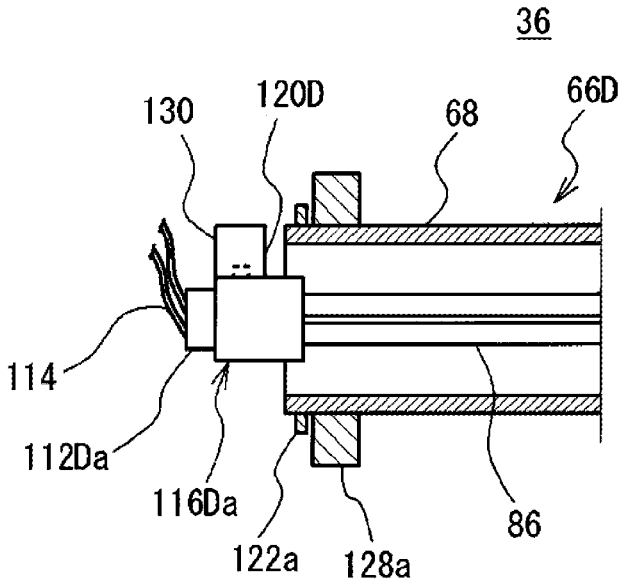
FIG. 7A is a partial sectional view of the heating unit according to the third exemplary embodiment.
Figure 7B:
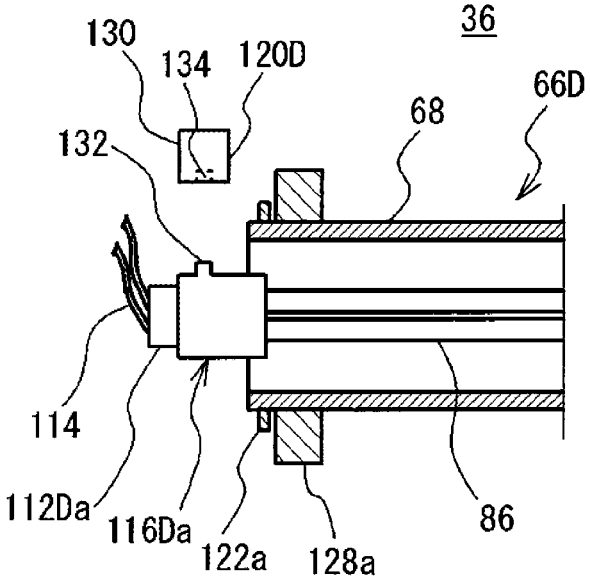
FIG. 7B is a partial sectional view showing a state in which the cover part and a projecting portion are separated.

In the first exemplary embodiment and the modification of the first exemplary embodiment, the projecting portions 118 and 118A are formed integrally with the cover parts 116*a* and 116Aa, and in the second exemplary embodiment and the modification of the second exemplary embodiment, the projecting portions 119B and 119C are formed integrally with the cover parts 116Ba and 116Ca. The present invention is not limited to such configurations. As shown in FIGS. 7A and 7B, it is also possible that a separately formed projecting portion 130 is attached to a cover part 116Da. The configurations the same as those in the first exemplary embodiment will be denoted by the same reference signs, and detailed descriptions thereof will be omitted.

Specifically, in the third exemplary embodiment, as shown in FIG. 7B, the cover part 116Da that covers a supply part 112Da of the heating unit 66D has a projection 132 on which the projecting portion 130 is attached, and the projecting portion 130 has a hole 134 into which the projection 132 formed on the cover part 116Da is inserted.

By fitting the hole 134 in the projecting portion 130 onto the projection 132 of the cover part 116Da, the projecting portion 130 is attached to the cover part 116Da. At this time, a surface of the projecting portion 130 facing the heating roller 68 constitutes a restriction part 120D.

In the third exemplary embodiment, although the cover part 116Da has the projection 132, and the projecting portion 130 has the hole 134, the cover part may have a hole, and the projecting portion may have a projection.

In this configuration, compared with a case where the cover part and the projecting portion that form the restriction part are not formed of different members, the shape of the cover part is simple, and thus, manufacturing is easy.

The cover part 116Da and the projecting portion 130 do not necessarily have to be joined together by using the projection 132 and the hole 134 and may be joined together by another joining method, such as screwing, welding, or the like.

In the third exemplary embodiment, although one projecting portion 130 is attached to the cover part 116Da, multiple projecting portions may be attached to the cover part 116Da.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a rotary member;

a heating member provided inside the rotary member;

supply parts configured to supply power to the heating member;

cover parts that cover the supply parts; and fixing members that fix the rotary member in an axial direction of the rotary member, wherein the cover parts have a restriction part configured to restrict movement of the rotary member in the axial direction.

2. The fixing device according to claim 1, wherein the cover parts are provided at longitudinal ends of the heating member, and wherein the restriction part is not provided on the cover part located opposite from the cover part having the restriction part.

3. The fixing device according to claim 2, wherein the rotary member has, at one end or the other end in the axial direction, a transmitting member configured to receive a driving force transmitted from a driving unit and to rotate the rotary member, and wherein the restriction part is provided on the cover part opposite from the transmitting member.

4. The fixing device according to claim 3, wherein the cover parts have at least one projecting portion projecting in a direction intersecting a longitudinal direction of the heating member, and wherein the restriction part is provided on the projecting portion, at a portion near the rotary member.

5. The fixing device according to claim 4, wherein the projecting portion is attachable to and detachable from the cover part.

6. The fixing device according to claim 2, wherein the cover parts have at least one projecting portion projecting in a direction intersecting a longitudinal direction of the heating member, and wherein the restriction part is provided on the projecting portion, at a portion near the rotary member.

7. The fixing device according to claim 6, wherein the projecting portion is attachable to and detachable from the cover part.

8. The fixing device according to claim 1, wherein the cover parts have at least one projecting portion projecting in a direction intersecting a longitudinal direction of the heating member, and wherein the restriction part is provided on the projecting portion, at a portion near the rotary member.

9. The fixing device according to claim 8, wherein the projecting portion is attachable to and detachable from the cover part.

10. An image forming apparatus comprising:

a fixing device that includes:

a rotary member;

a heating member provided inside the rotary member;

supply parts configured to supply power to the heating member;

cover parts that cover the supply parts; and fixing members that fix the rotary member in an axial direction of the rotary member, wherein the cover parts have a restriction part configured to restrict movement of the rotary member in the axial direction.

11. A fixing device comprising:

a rotary member;

a heating member provided inside the rotary member;

supply means for supplying power to the heating member;

cover means for covering the supply means; and fixing members for fixing the rotary member in an axial direction of the rotary member, wherein the cover means have restriction means for restricting movement of the rotary member in the axial direction.

* * * * *